United States Patent [19]

Kittel et al.

[11] 4,386,862

[45] Jun. 7, 1983

[54] SYSTEM FOR INTRODUCING FUNCTION CONTROL INSTRUCTIONS INTO A DATA WRITING OFFICE MACHINE

[75] Inventors: Arthur Kittel, Wilhelmshaven; Heiner Gerken, Jever; Herbert Behrens, Neuenburg, all of Fed. Rep. of Germany

[73] Assignee: Olympia Werke AG, Wilhelmshaven, Fed. Rep. of Germany

[21] Appl. No.: 296,485

[22] Filed: Aug. 26, 1981

Related U.S. Application Data

[63] Continuation of Ser. No. 96,376, Nov. 21, 1979, abandoned.

[30] Foreign Application Priority Data

Nov. 21, 1978 [DE] Fed. Rep. of Germany ..... 2850378

[51] Int. Cl.[3] ..... B41J 1/30

[52] U.S. Cl. ..... 400/144.2; 400/175

[58] Field of Search ..... 400/144.2, 144.3, 174, 400/175, 76, 82, 149–151.1; 101/111

[56] References Cited

U.S. PATENT DOCUMENTS

| | | | |
|---|---|---|---|
| 3,924,724 | 12/1975 | Kerzel | 400/175 |
| 3,987,885 | 10/1976 | Diamond | 400/208 X |
| 4,074,798 | 2/1978 | Berger | 400/144.3 |
| 4,209,262 | 6/1980 | Savage | 400/144.2 |

*Primary Examiner*—Paul T. Sewell

*Attorney, Agent, or Firm*—Spencer & Kaye

[57] ABSTRACT

In the combination of an office machine for writing data and a source of a set of printing types including a carrier carrying such printing type set and a cassette in which the carrier is housed and which is insertable in the machine and exchangeable for other cassettes housing carriers carrying respectively different type sets, the office machine being provided with a receiving unit for receiving at least a portion of such cassette and holding such portion in an inserted position in the machine, there are provided control elements carried by the portion of the cassette and receiving members located in the region of the receiving unit to cooperate with the control elements of a cassette portion in the inserted position for initiating at least one of the operations of setting the machine to the particular printing type carried by the carrier and identified by the control elements, and supplying operating power to the machine.

22 Claims, 6 Drawing Figures

FIG.1
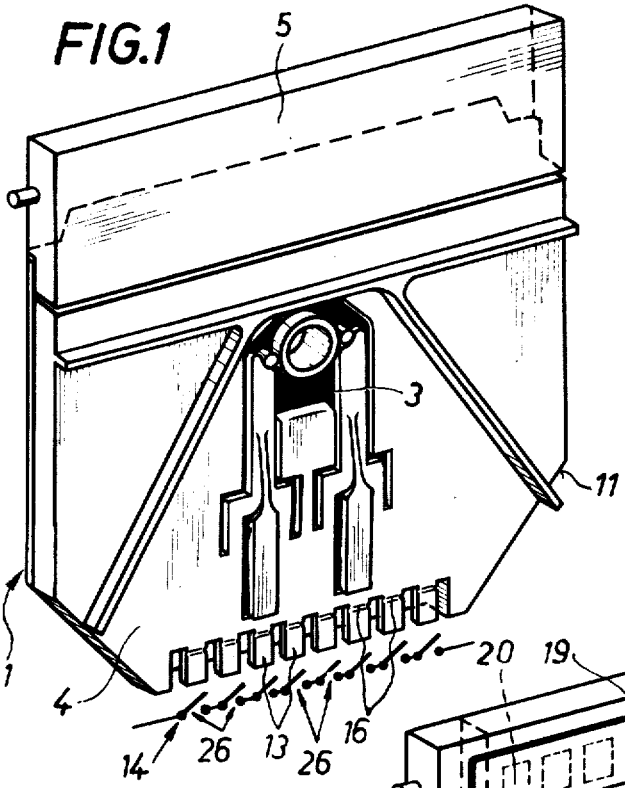
FIG.2
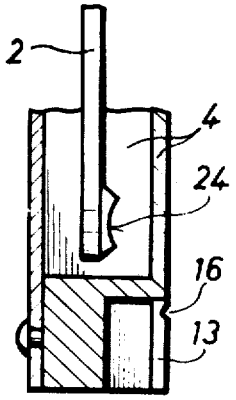
FIG.4
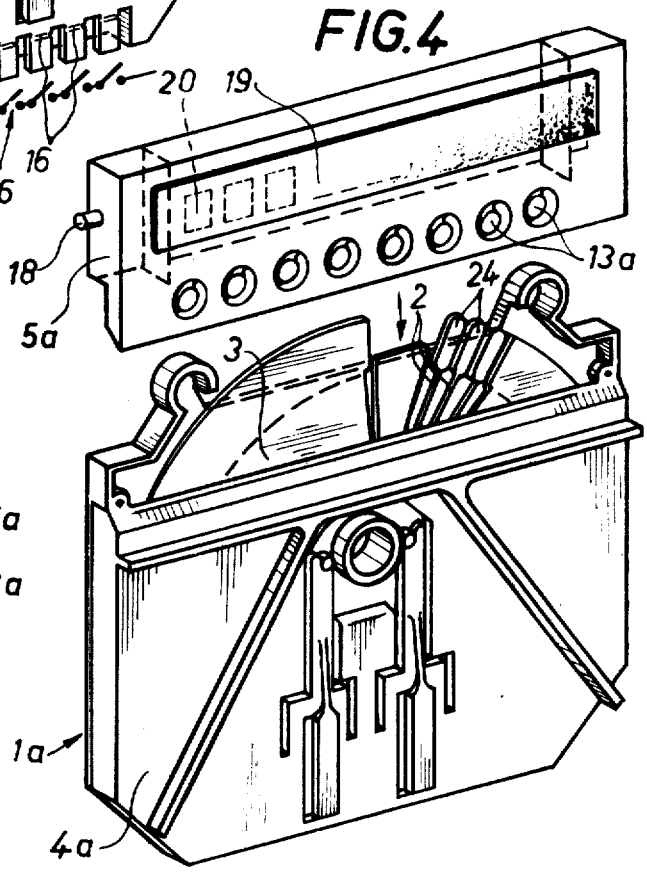
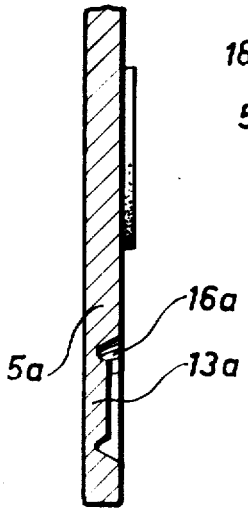
FIG.3

SYSTEM FOR INTRODUCING FUNCTION CONTROL INSTRUCTIONS INTO A DATA WRITING OFFICE MACHINE

CROSS-REFERENCE TO RELATED APPLICATION

This application is a continuation of application Ser. No. 096,376, filed Nov. 21st, 1979, now abandoned.

BACKGROUND OF THE INVENTION

The present invention relates to data writing office machines, such as typewriters, of the type employing a removable multiple type carrier, such as a print wheel, housed in a cassette.

It is known to dispose a multiple type carrier, particularly a print wheel provided with spokes carrying type faces, in a cassette, as disclosed, for example, in FRG Offenlegungsschrift [Laid-open Application] No. 2,803,433, for insertion into and removal from a printing mechanism of the office machine. In the inserted state, the type carrier is positioned between a setting device including a hammer mechanism and a printing abutment. In the embodiment disclosed in the above-cited publication this is done in such a manner that the print wheel remains in the cassette during operation, i.e. the print wheel must be connected with a rotary setting shaft in the interior of the machine while it is disposed in the cassette.

Such a device is able to perform its basic functions, which are to protect the print wheel against damage and to prevent soiling of the user's hands while a used print wheel is being replaced by a new one, in a satisfactory manner and it is therefore advisable to use such a device in an appropriate design.

SUMMARY OF THE INVENTION

It is an object of the present invention to provide a replaceable cassette of the above-described type which can perform further functions in conjunction with a device provided in an office machine.

These and other objects are achieved, according to the invention, in the combination of an office machine for writing data and a source of a set of printing types including a carrier carrying such printing type set and a cassette in which the carrier is housed and which is insertable in the machine and exchangeable for other cassettes housing carriers carrying respectively different type sets, the office machine being provided with receiving means for receiving at least a portion of such cassette and holding such portion in an inserted position in the machine, by the provision of means defining control elements carried by the portion of the cassette and receiving members located in the region of the receiving means to cooperate with the control elements of a cassette portion in the inserted position for initiating at least one of the operations of setting the machine to the particular printing type carried by the carrier and identified by the control elements, and supplying operating power to the machine.

Further features of the present invention will be described hereinafter.

The control elements can be, for example, mechanically acting, detachable tabs or discs, magnetically acting regions of a magnetizable foil, or electrically acting outputs of an electronic memory element containing a program. The control elements can be carried by the body portion, or receptacle, or by the cover portion of the cassette, making it possible to supply the office machine with control instructions when the cassette portion carrying the elements is inserted into the receiving means of the machine. The control instructions can relate, for example, to machine settings dictated by the particular printing types carried by the carrier disposed in the cassette.

These control instructions may act, for example, on a processor provided in the office machine in such a manner that the carriage of the machine is driven at line and letter spacings which are adapted to the script of the printing type selected (e.g. 2.54 mm, 2.12 mm, or proportional spacing).

Additionally, with the present invention the office machine can be provided with a program or a program can be called up in the office machine for adjusting the energy supplied to the hammer mechanism individually for each separate printing type character or for the set of printing types carried by the carrier, i.e. with respect to a certain type of script.

A further use for the present invention would be in office machines which are to be designed to be set for various different languages, e.g. for the purpose of changing the direction of print from left-to-right movement of the carriage to right-to-left movement of the carriage.

Another example for the use of the present invention is to cause insertion of a type carrier into the office machine to initiate automatic presentation, on the keyboard, of symbols corresponding to the printing types provided on the type carrier. Such keyboards, in which the symbols associated with individual keys can be changed, for example by optical means, are generally known and their structural configuration need not be discussed in detail here.

Additionally, the present invention permits addressing a microprocessor of an office machine, or reading out therefrom a program which is directed toward a special type carrier so that, e.g., with the actuation of but a single key, a sequence of successively printed different types can be actuated, for example to produce a representation of a benzene ring when writing a chemical formula.

In detail, the device according to the present invention may be constructed so that a portion of the cassette contains, as the control elements, an electronic component which is active as a memory unit, e.g. a ROM, outside of the machine and may contain only part of a program for the total microprocessor in the machine. The electronic component is then connected with the machine microprocessor by insertion of the cassette portion into the office machine to bring connecting contacts of the electronic component into contact with connectors in the machine and defining receiving members. Advisably, if the device according to the present invention is of such design, a cassette portion is additionally provided, for safety reasons, with a control element, such as a projection or surface, which coacts, for example, with receiving means in the form of a contact switch in the interior of the machine with which the microprocessor can then be switched off before the external memory unit is separated therefrom, or with which the operational readiness of the office machine can be interrupted by interrupting the supply of operating power thereto.

German Auslegeschrift [Published Application] No. 2,243,204 has already disclosed a printing mechanism in which chain-like type carriers are disposed in type carrier cassettes wherein the type carriers can be exchanged in order to be able to convert the printing mechanism for separately checking individual print types from various type sets. The type carrier cassette disclosed here is already provided with a coding device which can be brought into operative connection with a printer control and which enables the printer control to identify the individual printing types passing by the printing positions and to feed printing signals, if appropriate, to a hammer mechanism. This device only serves to select printing types in a line printer with flying imprint, which is entirely different from the approach and solution of the present invention.

It has further been found to be advisable to construct the cover of the replaceable cassette so that its insertion into a receptacle in the office machine serves to operate a switch which turns the machine on even if no other control elements are provided at such cover since this reliably prevents loss of the cover.

BRIEF DESCRIPTION OF THE DRAWINGS

FIG. 1 is a perspective view of one preferred embodiment of a cassette according to the invention.

FIG. 2 is a cross-sectional, detail view of the lower portion of the cassette of FIG. 1.

FIG. 3 is a cross-sectional, detail view of a portion of a cassette cover according to a second preferred embodiment of the invention.

FIG. 4 is a perspective view of a cassette according to the invention provided with a cover having the form shown in FIG. 3.

DESCRIPTION OF THE PREFERRED EMBODIMENTS

Figure 5:
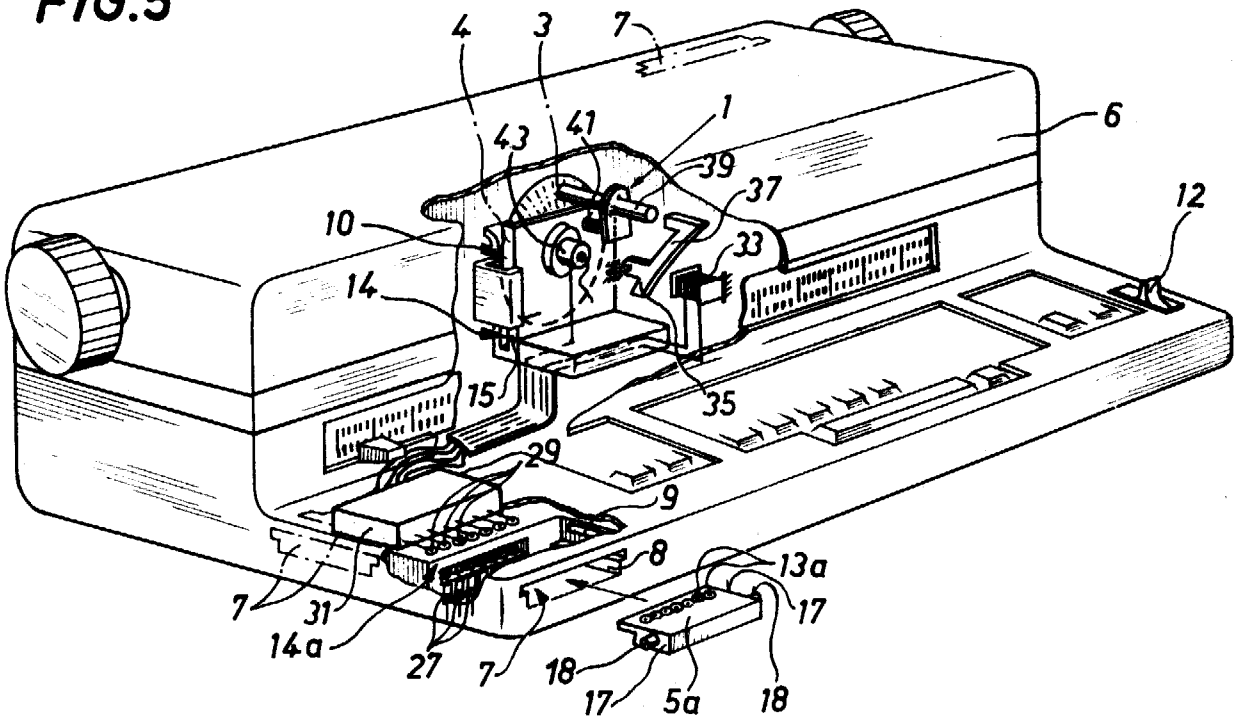
FIG. 5 is a perspective, greatly simplified illustration of an office machine provided with receiving members according to the invention.

As shown in FIG. 1, a replaceable cassette 1, in which a print wheel 3 provided with individual spokes 2 visible in FIG. 4, carrying individual type faces, is permanently disposed, may be composed of a receptacle 4 for the print wheel 3 and a cover 5. The cover 5 is removed from the receptacle 4 when the receptacle and thus the print wheel 3 are mounted in receiving means of an office machine 6, as shown in FIG. 5, and the cover is then itself inserted into other receiving means in the office machine 6, in this case a receiving recess 7 which forms an insertion passage 8. This insertion passage 8 may be provided with an actuatable receiving member in the form of a switching element 9 which can be actuated by the inserted cover 5 and which is, for example, a switching contact within the operating power circuit of the office machine. Various possible alternative locations for recess 7 are shown in dot-dash lines.

Such a switching element 9, however, which is connected, for example, in series with a power switch 12 for the machine, may also be provided in the receiving means for the receptacle 4 of the replaceable cassette 1. These latter receiving means will then be in the form of an insertion passage 10 so that then the switching element 9 is actuated by a control element in the form of a projection or surface 11, shown in FIG. 1, which is provided on the receptacle 4 and acts as control means for switching the machine on.

As shown in FIGS. 1 and 2, a number of control elements 13 may be provided at the bottom of receptacle 4 to act on receiving members 14 provided in the office machine. These receiving members sense the presence of the control elements and thus influence the operating mode of the machine. These receiving members 14, which are not shown in detail, are provided in the lower region 15 of the insertion passage 10 and are constituted by electrical contact elements each of which opens or closes a control circuit path when acted on by a respective element 13. These electrical contact elements consist of microswitches 26 and are normally open and are closed by the respective elements 13 when the cassette 1 is in the office machine.

The elements 13 which act as control means include tabs which are made of the same material as, or are integral with, the receptacle 4 and are connected therewith via weakening lines 16 so that they can individually broken off. These tabs act on the receiving members 14, which sense the tabs remaining on the receptacle and generate, for example, a binary coded signal for a microprocessor (not shown in detail) provided in the office machine, or directly actuate function control devices of the office machine.

As shown in FIGS. 3 and 4, the control elements 13*a* which act as control means may also be provided at the associated cover 5*a* of the replaceable cassette 1*a* and can be constituted by discs which can be individually broken out of the cover along circular weakening, or break-out, lines 16*a*. In this case, as shown in FIG. 5 as well, receiving members 14*a* must of course be provided in the immediate area of the receiving means for the cover 5*a* which are formed by the insertion passage 8. The receiving members 14*a* may here be optical sensors formed by photodiodes 29 or phototransistors and associated light sources 27. Receiving members 14 could be similarly constructed. Alternatively, receiving member 14*a* could be electrical contacts switched by discs 13*a* or tabs 13*b*, shown in FIG. 6.

In order to be able to assure that the cover 5*a* of the replaceable cassette 1 is inserted with proper orientation into the insertion passage 8, this passage is given a T-shaped cross section and the lateral longitudinal edges of the cover 5*a* are provided with protrusions 18 located asymmetrically to the center lines of edges 17 when seen in the insertion direction.

As further shown in FIGS. 3 and 4, instead of, or in addition to, removable control elements, a magnetic foil 19 may be fastened to part of the cassette, e.g. to the cover 5*a*. This foil 19 may be provided with individually magnetizable regions 20 the pattern of which is sensed by the receiving members, which generate appropriate control signals. With a replaceable cassette of such design the receiving members logically then consist of magnetically influencable read-out means, e.g. a magnetic reading head which can be moved laterally for read-out and which, being well known, is not shown or described here in detail.

Figure 6:
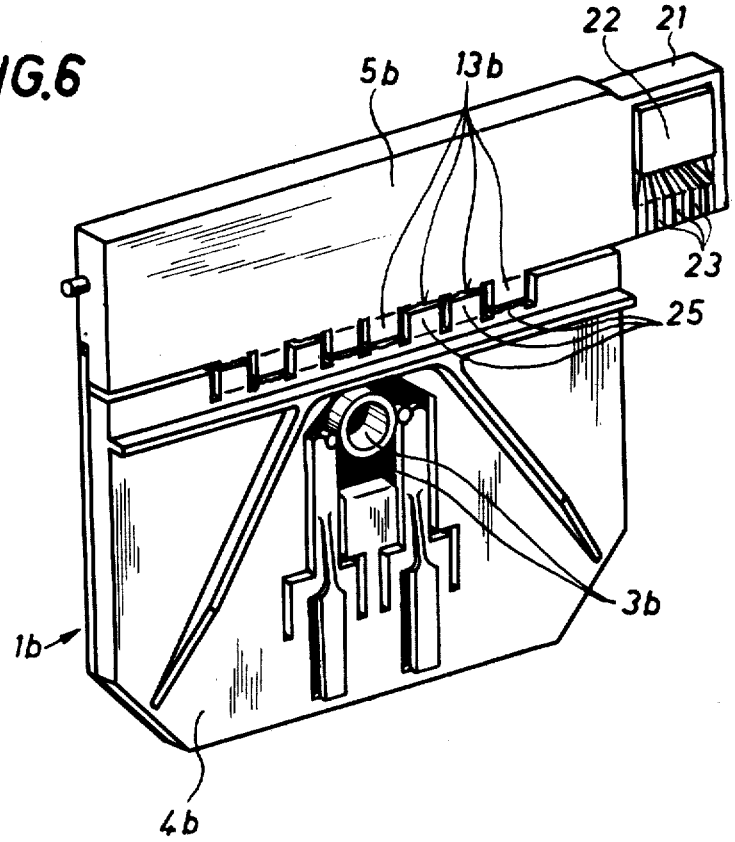
FIG. 6 is a view similar to that of FIG. 1 of a cassette according to a further preferred embodiment of the invention.

FIG. 6 shows a further embodiment of the invention in the form of a replaceable cassette 1*b* including a receptacle 4*b* and a cover 5*b*, in which control elements are presented by an electronic component 22 including a memory chip, e.g. a "ROM" chip provided in part of the cassette, for example in an extension 21 of the cover 5*b*. This component, which is thus external of the machine when the receptacle and cover are inserted therein, may contain part of the program for the microprocessor in the interior of the machine. Component 22 is permanently fastened to cover 5*b* and can be brought into operating connection with receiving members acting as countercontacts in the receiving means, i.e. the insertion passage, by means of sturdy electrical conductors 23, e.g. conductors that are printed on or glued to cover 5*b*.

Additionally, as also shown in FIG. 6, receptacle 4*b* can be provided with a checking device capable of preventing a print wheel 3*b* provided with a certain set of printing types from being associated with the wrong cover 5*b* which consequently would have a pattern of control elements 13*b* that does not coincide with the respective set of printing types. This check device includes check projections 25 which can likewise be broken out individually and which correspond in number and position to the elements 13*b*. Selected check protrusions 25 can then be broken out in such a pattern that they can correspond with the guide control elements 13*b* for mutual checking.

The combinations of means required for operation of the device, described above with regard to various embodiments, have been freely selected for the simplified illustration of the present invention and it should be apparent that other combinations and structural embodiments are likewise conceivable and thus are also part of the present invention. To print a selected character the typewheel 3 is rotated by a motor 43 and a drive circuit 31 until the selected type element 24 is moved to the printing position between the hammer 39 and the platen, not shown. The electromagnet 33 is energized by the drive circuit 31 too and attracts the lower end portion 35 of the lever 37, causing the same to pivot counterclockwise. The upper end portion of the lever 37 engages with the hammer 39 and moves the same leftwardly into engagement with the selected type element 24. Further movement of the hammer 39 causes the selected type element 24 to impact against the sheet, not shown, thereby printed the selected character. The hammer 39 is returned to the rest position thereof to rebound force, the resilience of the arm 2 exerted thereon and the force of the return spring 41.

The motor 43 and the electromagnet 33 are electrical connected with the drive circuit 31 getting electrical impulses from the phototransistors 29. The light beam, which may be continuously emitted by a respective light source 27, e.g. a GaAs diode is interrupted on its way toward the associated phototransistor 29 or other light receiver by disks 13*a* which are not breaken out in the cover 5*a*. When the disks 13*a* are breaken out, the light beam receiving the phototransistors sending electrical impulses to the drive circuit 31.

It will be understood that the above description of the present invention is susceptible to various modifications, changes and adaptations, and the same are intended to be comprehended within the meaning and range of equivalents of the appended claims.

What is claimed is:

1. In the combination of an office machine for writing data and a source of a set of printing types including a carrier carrying such printing type set and a cassette in which the carrier is housed and which is insertable in the machine and exchangeable for other cassettes housing carriers carrying respectively different type sets, the office machine being provided with receiving means for receiving at least a portion of such cassette and holding such portion in an inserted position in the machine, the improvement comprising: means defining control elements carried by said portion of said cassette and receiving members located in the region of said receiving means to cooperate with said control elements of a cassette portion in the inserted position for initiating at least one of the operations of setting the machine to the particular printing type carried by the carrier and identified by said control elements and supplying operating power to the machine, and wherein said cassette comprises a removable cover member constituting said portion carrying said control elements, and said receiving means present a receiving passage for receiving said removable cover member.

2. An arrangement as defined in claim 1 wherein said control elements constitute means identifying the particular printing type carried by the carrier in said cassette.

3. An arrangement as defined in claim 1 wherein said control elements are constituted by detachable control tabs.

4. An arrangement as defined in claim 3 wherein said control tabs are made of the same material as said cassette portion and are attached thereto via regions which are easily broken.

5. An arrangement as defined in claim 1 further comprising a foil of magnetizable material carried by said cassette portion and wherein said control elements are constituted by the state of magnetization of respective regions of said foil.

6. In the combination of an office machine for writing data and a source of a set of printing types including a carrier carrying such printing type set and a cassette in which the carrier is housed and which is insertable in the machine and exchangeable for other cassettes housing carriers carrying respectively different type sets, the office machine being provided with receiving means for receiving at least a portion of such cassette and holding such portion in an inserted position in the machine, the improvement comprising: means defining control elements carried by said portion of said cassette and receiving members located in the region of said receiving means to cooperate with said control elements of a cassette portion in the inserted position for initiating at least one of the operations of setting the machine to the particular printing type carried by the carrier and identified by said control elements and supplying operating power to the machine, and wherein said cassette is composed of two portions one of which carries said control elements, and wherein the other portion of said cassette is provided with check elements formed to conform to the control elements of its associated one portion for permitting said cassette portions to be assembled together only when they belong together.

7. An arrangement as defined in claim 1 wherein said receiving members are optical sensors.

8. An arrangement as defined in claim 7 wherein said cassette comprises a receptacle carrying the carrier and a cover for closing the receptacle when said cassette is removed from the machine, said receptacle constitutes said portion carrying said control elements, and said receiving means comprise means defining an insertion passage for receiving said receptacle.

9. An arrangement as defined in claim 1 wherein said receiving members are electrical contacts each connected in a current circuit.

10. An arrangement as defined in claim 1 wherein said receiving members comprise magnetic read-out elements.

11. In the combination of an office machine for writing data and a source of a set of printing types including a carrier carrying such printing type set and a cassette in which the carrier is housed and which is insertable in the machine and exchangeable for other cassettes housing carriers carrying respectively different type sets, the office machine being provided with receiving means for receiving at least a portion of such cassette and holding such portion in an inserted position in the machine, the improvement comprising: means defining control elements carried by said portion of said cassette and receiving members located in the region of said receiving means to cooperate with said control elements of a cassette portion in the inserted position for initiating at least one of the operations of setting the machine to the particular printing type carried by the carrier and identified by said control elements and supplying operating power to the machine, and wherein said control elements comprise an electronic memory device for a microprocessor disposed in the machine, and said memory device comprises means for producing electrical control signals when said portion is in the inserted position in the machine, and electrical contacts connectable to the microprocessor for delivering the electrical signals thereto when the machine is in operation.

12. An arrangement as defined in claim 11 wherein said memory device is a ROM.

13. An arrangement as defined in claim 11 wherein said memory device contains part of a program for the microprocessor.

14. In the combination of an office machine for writing data and a source of a set of printing types including a carrier carrying such printing type set and a cassette in which the carrier is housed and which is insertable in the machine and exchangeable for other cassettes housing carriers carrying respectively different type sets, the office machine being provided with receiving means for receiving at least a portion of such cassette and holding such portion in an inserted position in the machine, the improvement comprising: means defining control elements constituted by detachable control tabs carried by said portion of said cassette and made of the same material as said portion and attached thereto via regions which are easily broken, and receiving members located in the region of said receiving means to cooperate with said control elements of a cassette portion in the inserted position for initiating at least one of the operations of setting the machine to the particular printing type carried by the carrier and identified by said control elements and supplying operating power to the machine, and wherein said easily broken regions are regions of reduced thickness which enable each said tab to be easily broken away from said cassette portion, to leave at least one control tab the position of which defines the specific operation to be initiated.

15. In the combination of a carrier carrying a set of printing types and a cassette in which the carrier is housed and which is insertable in an office machine for writing data, which machine is arranged to receive at least a portion of the cassette, the cassette being exchangeable for other cassettes housing carriers carrying respectively different type sets, the improvement comprising: means constituted by detachable control tabs made of the same material as said portion of said cassette and defining control elements attached to said portion of said cassette via regions which are easily broken to cooperate with receiving members located in the office machine when said cassette portion is inserted in the machine for initiating at least one of the operations of setting the machine to the particular printing type carried by the carrier and identified by said control elements and supplying operating power to the machine and wherein said easily broken regions are regions of reduced thickness which enable each said tab to be easily broken away from said cassette portion, to leave at least one control tab the position of which defines the specific operation to be initiated.

16. An arrangement as defined in claim 17 wherein said control elements constitute means identifying the particular printing type carried by the carrier in said cassette.

17. An arrangement as defined in claim 15 wherein said cassette comprises a removable cover member constituting said portion carrying said control elements.

18. In the combination of a carrier carrying a set of printing types and a cassette in which the carrier is housed and which is insertable in an office machine for writing data, which machine is arranged to receive at least a portion of the cassette, the cassette being exchangeable for other cassettes housing carriers carrying respectively different type sets, the improvement comprising: means defining control elements carried by said portion of said cassette to cooperate with receiving members located in the office machine when said cassette portion is inserted in the machine for initiating at least one of the operations of setting the machine to the particular printing type carried by the carrier and identified by said control elements and supplying operating power to the machine, and wherein said cassette is composed of two portions one of which carries said control elements, and wherein the other portion of said cassette is provided with check elements formed to conform to the control elements of its associated one portion for permitting said cassette portions to be assembled together only when they belong together.

19. An arrangement as defined in claim 15 wherein said cassette comprises a receptacle carrying the carrier and a cover for closing the receptacle when said cassette is removed from the machine, and said receptacle constitutes said portion carrying said control elements.

20. In the combination of a carrier carrying a set of printing types and a cassette in which the carrier is housed and which is insertable in an office machine for writing data, which machine is arranged to receive at least a portion of the cassette, the cassette being exchangeable for other cassettes housing carriers carrying respectively different type sets, the improvement comprising: means defining control elements carried by said portion of said cassette to cooperate with receiving members located in the office machine when said cassette portion is inserted in the machine for initiating at least one of the operations of setting the machine to the particular printing type carried by the carrier and identified by said control elements and supplying operating power to the machine, and wherein said control elements comprise an electronic memory device for a microprocessor disposed in the machine, and said memory device comprises means for producing electrical control signals when said portion is in the inserted position in the machine, and electrical contacts connectable to the microprocessor for delivering the electrical signals thereto when the machine is in operation.

21. An arrangement as defined in claim 20 wherein said memory device is a ROM.

22. An arrangement as defined in claim 20 wherein said memory device contains part of a program for the microprocessor.

* * * * *